US005678443A

United States Patent [19]

Frigerio et al.

[11] Patent Number: 5,678,443

[45] Date of Patent: Oct. 21, 1997

[54] TAKEUP DRUM FOR WIRE DRAWING MACHINE

[75] Inventors: Marco Frigerio, Lierna; Luigi Arnoldi, Lecco, both of Italy

[73] Assignee: Mario Frigerio S.p.A., Lecco, Italy

[21] Appl. No.: 666,701

[22] Filed: Jun. 18, 1996

[30] Foreign Application Priority Data

Jul. 7, 1995 [IT] Italy ..... MI95A1475

[51] Int. Cl.[6] ..... B21C 1/14; B21C 9/00

[52] U.S. Cl. ..... 72/286; 72/289

[58] Field of Search ..... 72/286, 289, 287, 72/274, 282

[56] References Cited

U.S. PATENT DOCUMENTS

| | | | |
|---|---|---|---|
| 1,390,714 | 9/1921 | Hodgson | 72/289 |
| 2,241,956 | 5/1941 | Nye | 72/289 |
| 2,262,247 | 11/1941 | Nye . | |
| 2,481,944 | 9/1949 | Nye | 72/289 |
| 2,712,381 | 7/1955 | Bruestle | 72/289 |

FOREIGN PATENT DOCUMENTS

| | | | |
|---|---|---|---|
| 445489 | 10/1974 | U.S.S.R. | 72/286 |
| 939153 | 6/1982 | U.S.S.R. | 72/289 |
| 651708 | 4/1951 | United Kingdom . | |
| 781011 | 8/1957 | United Kingdom | 72/286 |
| 1146355 | 3/1969 | United Kingdom . | |
| 1159590 | 7/1969 | United Kingdom . | |

*Primary Examiner*—Daniel C. Crane

*Attorney, Agent, or Firm*—Guido Modiano; Albert Josif; Daniel O'Byrne

[57] ABSTRACT

A takeup drum, particularly for wire drawing machines, having a fluid cooling unit, the drum comprising: a cylindrical body, which is rotatable about a central axis and is supported, through bearings, by the fixed frame of the machine; a chamber that is formed in the body; and a drum cooling unit that is arranged in the chamber. The cooling unit comprises: at least one circular sector that is located proximate to the internal lateral surface of the body and is connected to the fixed frame that supports the cylindrical drum body; and at least one nozzle for introducing the cooling fluid, located proximate to the outer surface of the sector, so as to form a jacket of cooling fluid that flows over the internal lateral surface of the body.

20 Claims, 3 Drawing Sheets

1
2
3
4
5
6
10
12
16
17
17'
18
18'
19
20
21
22
23
24
25
26
27

TAKEUP DRUM FOR WIRE DRAWING MACHINE

BACKGROUND OF THE INVENTION

The present invention relates to takeup drums, particularly for wire drawing machines, which have a fluid cooling unit.

In wire drawing, the wire conventionally passes through a die, where its section is reduced by plastic deformation. The pulling action is applied by a drum, located downstream of the die, which by turning winds a certain number of turns of the wire on itself; in the case of multiple drawing machines, this operation is repeated several times in succession, guiding the wire from the drum to the next die, and so forth.

It is known that the energy used to produce the plastic deformation of the wire is converted into heat, which is partially transferred to the die and mostly to the wire itself.

In these machining operations there is inevitably the problem of removing heat from the wire, otherwise the structural characteristics of the wire would worsen, with severe consequences for the quality of the final product.

This removal is performed by providing heat exchange between the wire and the drum, and it is evident that the amount of heat transferred is directly proportional to the number of turns wound on the drum, to the drawing speed, and to the difference in temperature between the drum and the wire.

In order to increase the difference in temperature between the drum and the wire, it is extremely important to cool the drum, so as to increase the amount of heat that is removed from the wire.

In order to solve this problem, various solutions have currently been provided which use a fluid, particularly water, as heat exchange medium.

One of these solutions entails a preset amount of water which, being fed through a nozzle, is brought into contact with the hot wall of the drum. Circular elements, which are coaxial and internal to the drum wall, rotate rigidly with the drum and form interspaces in which the water, by means of a system of forced passages, is forced to flow and then exit through an outlet that is located centrally with respect to the drum wall.

Although this solution is simpler and more effective than previous ones, it still has several drawbacks; the main ones are: insufficient turbulence of the fluid in general and, in particular, the almost complete stagnation of the cooling fluid towards the lower part of the drum wall, where the greatest need for effective cooling is felt, since the lower part receives the hottest wire; recurring maintenance, due to the clogging of the fluid on the bottom of the interspaces; and rather complicated construction and assembly, in view of the large number of rotating components.

Furthermore, in this solution the profile of the lower part of the drum wall, at the drum supporting flange, has a thicker portion that hinders heat exchange between the wire and the fluid indeed in the position in which, as already mentioned earlier, the hottest wire is wound.

SUMMARY OF THE INVENTION

A principal aim of the present invention is to eliminate the drawbacks mentioned above, by providing a cooling unit that is capable of inducing satisfactory turbulence in the fluid while keeping it in contact with the drum body.

Within the scope of this aim, a particular object of the invention is to provide a unit that allows to cool the so-called "hot spot", i.e., the point where first contact with the wire occurs.

Another object of the present invention is to provide a cooling unit having a minimal number of rotating parts.

This aim, these objects, and others which will become apparent hereinafter are achieved by a takeup drum for a wire drawing machine comprising: a cylindrical body, which is rotatable about a central axis and is supported, by means of bearings, by the fixed frame of the machine; a chamber that is formed in said body; and a drum cooling unit that is arranged in said chamber; characterized in that said cooling unit comprises: at least one circular sector located proximate to the internal lateral surface of said body and connected to said fixed frame that supports said cylindrical body, and at least one nozzle for introducing the cooling fluid, located proximate to the outer surface of each sector, so as to form a jacket of cooling fluid that flows over the internal lateral surface of said body.

BRIEF DESCRIPTION OF THE DRAWINGS

Further characteristics and advantages of the present invention will become apparent from the following detailed description of a preferred but not exclusive embodiment of a drum comprising a fluid cooling unit, illustrated only by way of non-limitative example in the accompanying drawings, wherein.

DESCRIPTION OF THE PREFERRED EMBODIMENTS

Figure 1:
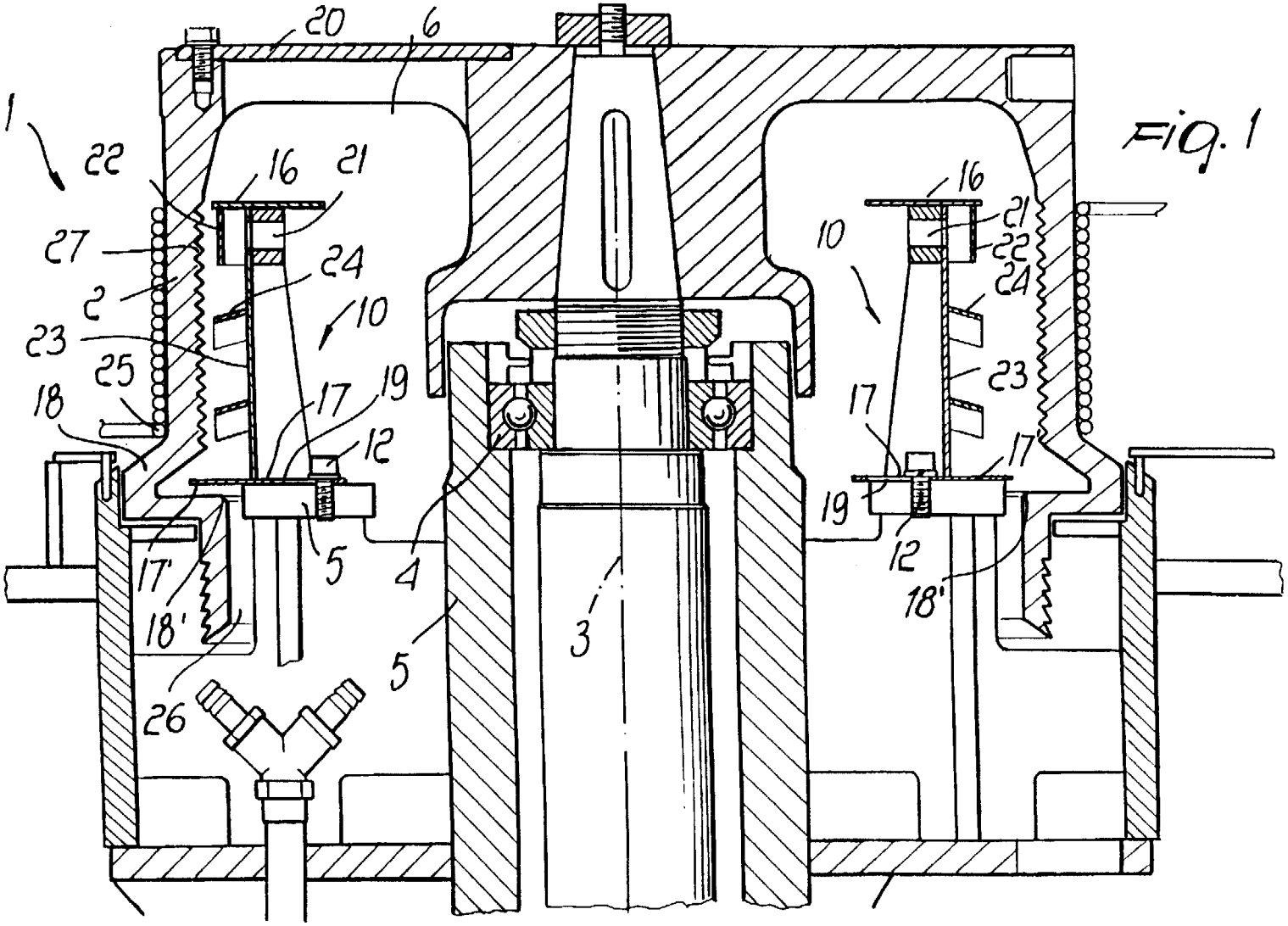
FIG. 1 is a schematic axial sectional view of the drum with the cooling unit according to the invention.

With reference to the above figures, the takeup drum of wire drawing machines, generally designated by the reference numeral 1, comprises: a cylindrical body 2 that is rotatable about a central axis 3 and is supported, by means of bearings 4, by the fixed frame 5 of the machine; a chamber 6 that is formed in said body; and a drum cooling unit that is located in said chamber.

Said cooling unit is constituted by at least one circular sector 10 that is coaxial to said axis 3 and is connected to the fixed frame by a coupling that is for example of the type using a screw or bolt 12.

Figure 2:
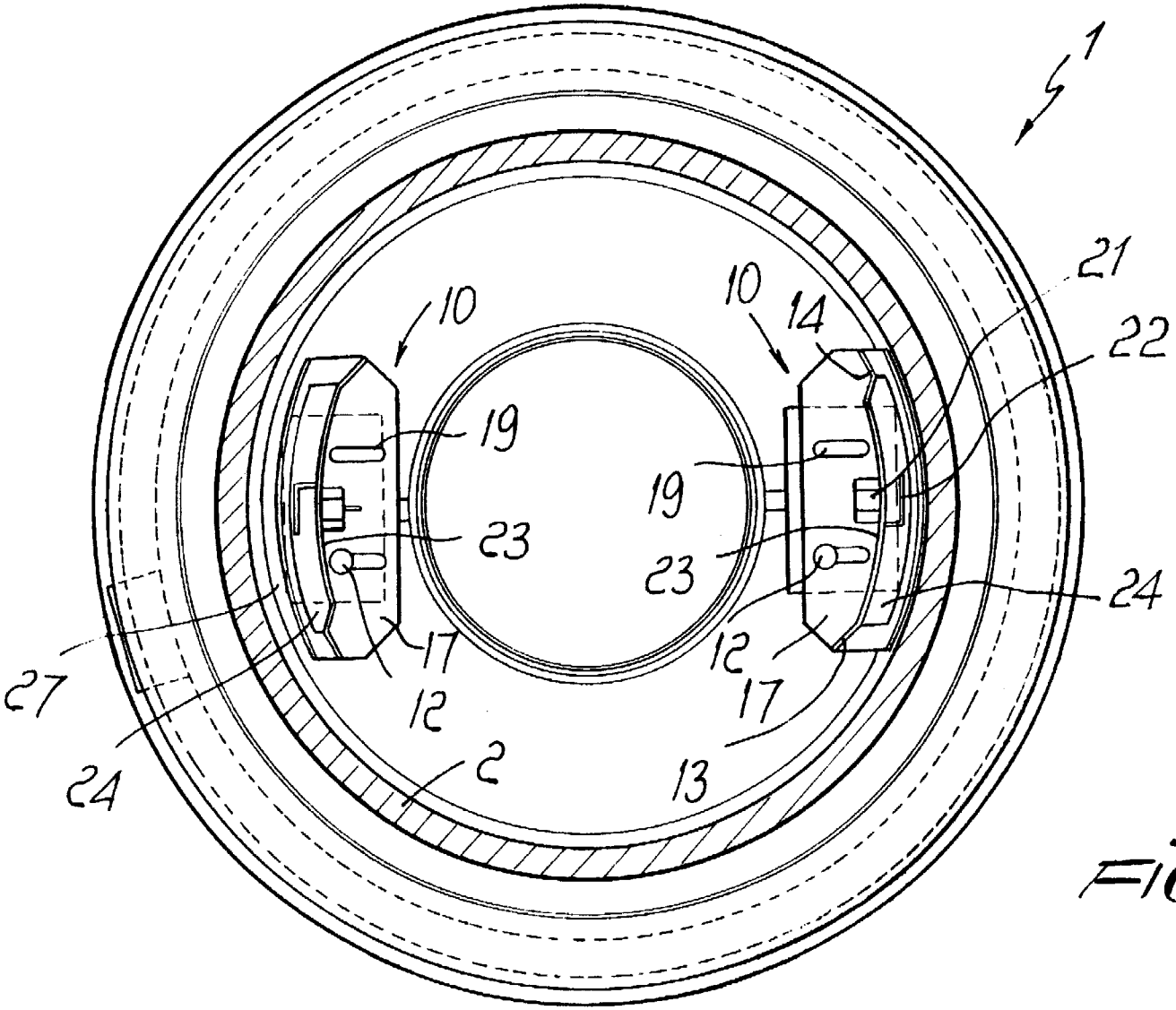
FIG. 2 is a top view of the drum with the cooling unit according to the invention.

FIGS. 1 and 2 illustrate an embodiment of the invention that uses two sectors in diametrically opposite positions. Of course, other embodiments, not shown in the figure, include even three or four sectors.

Figure 3:
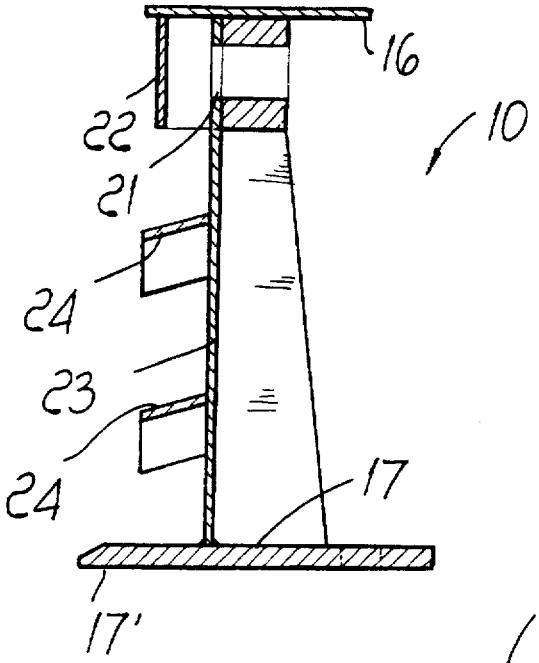
FIG. 3 is an axial sectional view of a sector.
Figure 4:
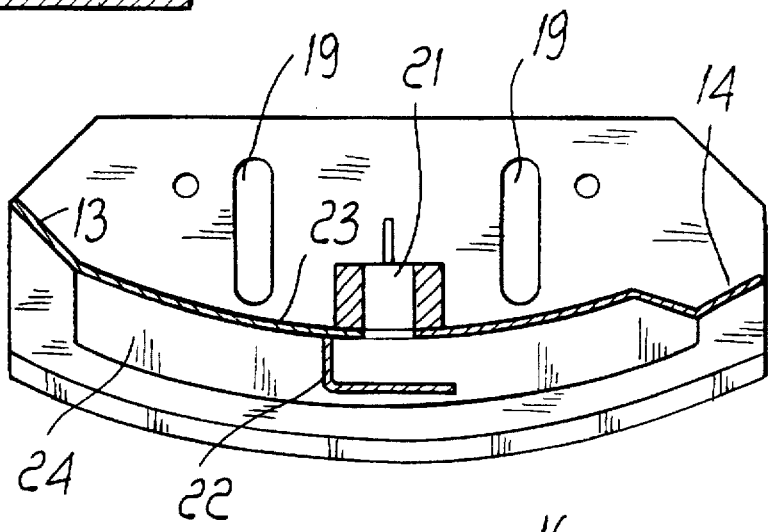
FIG. 4 is a sectional view, taken along the plane IV—IV of FIG. 3.
Figure 5:
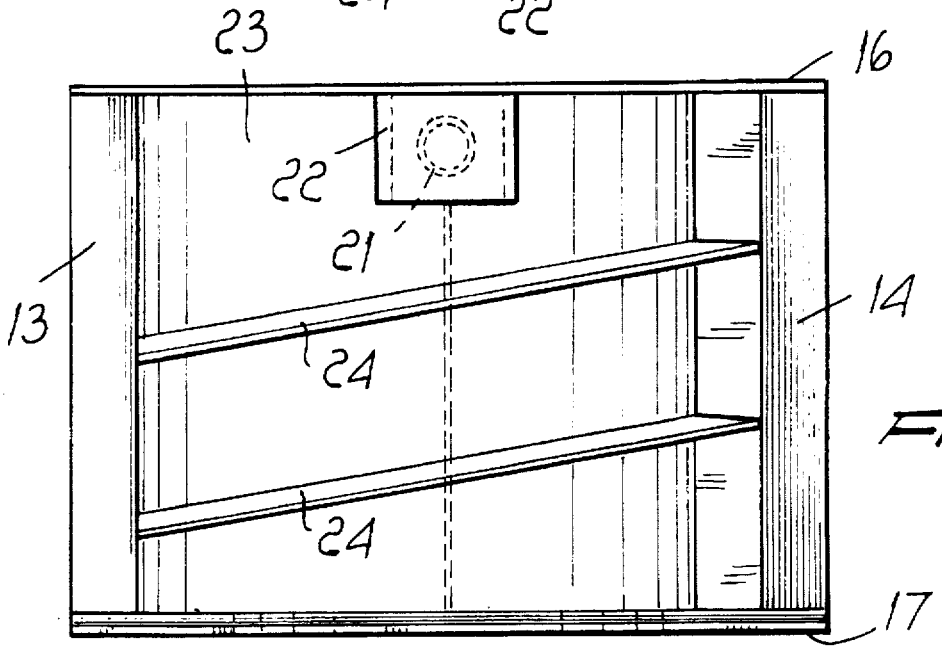
FIG. 5 is an external side view of one of the sectors.

With reference to FIGS. 3–5, the final shape of the sector is then further refined so as to better meet the fluid-dynamics and assembly requirements. For example, as shown in FIG. 4, the profile of the surface of the sector is modified at one end by means of a recess 13 that increases its distance from the surface of the cylindrical body 2 and, at the other end, by means of a V-shaped protrusion 14 that decreases its distance from said body.

The fluid is fed into said chamber by means of a nozzle 21 located proximate to the outer surface of said sectors.

A baffle 22 is connected to a flange 16 located in the upper part of the sector 10 and is located in front of said nozzle 21 to redirect the fluid that exits downwards and towards the cylindrical body 2.

Said cylindrical body 2 forms a hollow 18 on the internal surface, proximate to the flange. In said hollow, the end of the lower edge 18' is closer to the axis 3 than the internal lateral surface of said body 2.

Due to the rotation of said body, a jacket of cooling fluid, not shown in the figure, is formed which flows over the internal lateral surface of said body. The jacket of fluid thus formed is supported by the edge 18' of the previously described hollow 18.

The base of the segment 17 directed towards the drum wall has a protruding front edge 17'. Its main task is to direct the water towards said hollow 18, furthermore increasing its turbulence and therefore its cooling power in the so-called "hot spot".

Said hollow 18 thus allows to cool the part of the component that is subjected to the most intense heat loads.

Two slots 19 are formed on the base 17; by means of these slots, as mentioned, the sector 10 is fixed to the fixed frame 5 by a pivot or screw coupling 12.

Said slots 19, by running in a radial direction, are essential for disassembling or assembling the sector 10, since they allow its retraction or advancement, with the corresponding exit or insertion of the front edge 17' with respect to the hollow 18, and accordingly the extraction or insertion of said sector 10 through the top 20 of the drum.

FIG. 1 shows one sector inserted in the working position and another one in retracted position.

Fins 24 are provided on the outer surface 23 of the sector 10, run with a substantially helical arrangement along said surface, and interact with said fluid jacket.

The penetration of said fins 24 in the fluid, which adheres to the wall, increases the turbulence of said fluid and its movement along the cylindrical body 2 and therefore increases heat exchange. In order to further facilitate said heat exchange, the internal surface of said body 2 of the drum has, at the fluid, undulations 27 that increase its contact surface.

The described device allows to introduce, by means of the nozzle 21, a given amount of fluid, for example as a function of discharged fluid temperature monitoring, so as to keep the temperature of the system constant.

The fluid is discharged-from the chamber 6 by means of the passage 26.

In practice it has been observed that the invention thus described allows to obtain a device for cooling takeup drums for drawing machines that in addition to ensuring considerable effectiveness in cooling and optimum heat control, has a structure that is constructively simpler and in practice requires no maintenance, differently from conventional devices.

The invention thus conceived is susceptible of numerous modifications and variations, all of which are within the scope of the inventive concept.

All the details may furthermore be replaced with other technically equivalent elements.

In practice, the materials employed, as well as the contingent shapes and dimensions, may be any according to the requirements.

What is claimed is:

1. A takeup drum for a wire drawing machine comprising:

a cylindrical body for supporting a wound wire, said cylindrical body being rotatably supported about a central axis of a fixed frame;

a chamber that is formed in said body and is delimited by an internal lateral surface of said body; and a drum cooling unit that is arranged in said chamber;

wherein said cooling unit comprises:

at least one circular sector that is located proximate to the internal lateral surface of said body and is connected to said fixed frame that rotatably supports said cylindrical body; and at least one nozzle for introducing cooling fluid between the internal lateral surface of said body and an outer surface of said sector, so as to form a jacket of cooling fluid that flows over the internal lateral surface of said body;

and wherein said cylindrical body has a lower protruding flange at which a hollowed-out portion is provided at the internal lateral surface, said circular sector comprising a lower base having a front edge which protrudes at said hollowed-out portion and at least partially enters said hollowed-out portion.

2. A takeup drum according to claim 1, further comprising agitator means located on the outer surface of said sector for interacting with and agitating said jacket of cooling fluid.

3. A takeup drum according to claim 2, wherein said agitator means comprise at least one fin-like surface located on said sector and running, with a substantially helical arrangement, along the outer surface of said sector.

4. A takeup drum according to claim 1, wherein said nozzle is associated with a duct arranged inside said sector and wherein at least one baffle is arranged in front of said nozzle.

5. A takeup drum according to claim 1, wherein said hollowed-out portion defines a lower edge having an end which is closer to said axis than the internal lateral surface of said body, and wherein said lower edge delimits a region for forming said jacket of cooling fluid.

6. A takeup drum according to claim 1, wherein said cylindrical body has a top opening through which said sector can be inserted for assembly.

7. A takeup drum according to claim 1, wherein said sector comprises a lower base having a flange that is provided with slots for radially positioning said sector with respect to the internal lateral surface of said body.

8. A takeup drum for a wire drawing machine comprising:

a cylindrical body for supporting a wound wire, said cylindrical body being rotatably supported about a central axis of a fixed frame;

a chamber that is formed in said body and is delimited by an internal lateral surface of said body; and a drum cooling unit that is arranged in said chamber;

wherein said cooling unit comprises:

at least one circular sector that is located proximate to the internal lateral surface of said body and is connected to said fixed frame that rotatably supports said cylindrical body; and at least one nozzle for introducing cooling fluid between the internal lateral surface of said body and an outer surface of said sector, so as to form a jacket of cooling fluid that flows over the internal lateral surface of said body;

and wherein said sector comprises a lower base having a flange that is provided with slots for radially positioning said sector with respect to the internal lateral surface of said body.

9. A takeup drum according to claim 8, wherein said cylindrical body has a lower protruding flange at which a hollowed-out portion is provided at the internal lateral surface, said circular sector comprising a lower base having a front edge which protrudes at said hollowed-out portion and at least partially enters said hollowed-out portion, and wherein said hollowed-out portion defines a lower edge having an end which is closer to said axis than the internal lateral surface of said body, and wherein said lower edge delimits a region for forming said jacket of cooling fluid.

10. A takeup drum according to claim 9, wherein said cylindrical body has a top opening through which said sector can be inserted for assembly.

11. A takeup drum for a wire drawing machine comprising:

a cylindrical body with an outer cylindrical surface upon which a wire is windable;

a fixed frame portion upon which said cylindrical body is rotatable supported such that said cylindrical body is rotatable about a central axis;

a chamber formed inside said cylindrical body, said chamber being delimited by an internal wall of said cylindrical body;

at least one circular sector arranged inside said chamber in a fixed position with respect to the rotatable cylindrical body, said at least one circular sector having an outer lateral surface arranged relative to said internal wall of said cylindrical body so as to define a portion of said chamber extending between said outer lateral surface and said internal wall for containing a cooling fluid in contact with said internal wall;

a cooling fluid flow path arranged for introducing said cooling fluid into said portion of said chamber such that when said cylindrical body rotates with respect to said at least one circular sector a cooling fluid jacket is formed inside said portion of said chamber in contact with said internal wall of said cylindrical body;

a flange portion of said cylindrical body arranged at an end of said outer cylindrical surface of said cylindrical body, said flange portion protruding outwardly from said outer cylindrical surface of said cylindrical body with respect to said central axis;

a concentric wall portion of said internal wall which extends substantially oppositely in correspondence with an extension of said outer cylindrical surface of said cylindrical body, said concentric wall portion extending to an end thereof arranged substantially opposite to said end of said outer cylindrical surface at which said flange portion is arranged, said concentric wall portion having outermost portions with respect to said central axis at which cooling fluid contained in said portion of said chamber is arranged in nearest proximity with said outer cylindrical surface;

an internally hollowed-out portion of said flange portion of said cylindrical body which defines an outwardly extending space arranged at the end of the concentric wall portion, said outwardly extending space protruding outwardly with respect to said concentric wall portion of said internal wall and with respect to said central axis such that said outwardly extending space is arranged more distally from said central axis than said outermost portions of said concentric wall portion, and said at least one circular sector being arranged relative to said cylindrical body such that said portion of said chamber for containing the cooling fluid comprises said outwardly extending space.

12. The takeup drum of claim 11 wherein said internally hollowed-out portion is delimited by a lower edge which extends such that an inner end of the lower edge is arranged nearer said central axis than innermost portions of said concentric wall portion of said internal wall.

13. The takeup drum of claim 11 wherein said at least one circular sector comprises a protruding portion which protrudes with respect to said outer lateral surface of said circular sector into said outwardly extending space.

14. The takeup drum of claim 13 wherein said at least one circular sector comprises a base having radially extending slots for selectively fixing said at least one circular sector in selected radial positions with respect to said cylindrical body.

15. The takeup drum of claim 11 wherein said outwardly extending space has an essentially annular truncated-conical shape.

16. The takeup drum of claim 11 wherein said concentric wall portion of said internal wall of said cylindrical body extends substantially in correspondence with said outer cylindrical surface of said cylindrical body.

17. The takeup drum of claim 11 wherein undulations are positioned at said concentric wall portion of said internal wall of said cylindrical body.

18. The takeup drum of claim 11, further comprising helically extending fins provided on said outer lateral surface of said at least one circular sector.

19. The takeup drum of claim 11 wherein said cooling fluid flow path extends through a nozzle provided through said outer lateral surface of said at least one circular sector distally from said flange portion.

20. The takeup drum of claim 11 wherein at least one circular sector comprises at one end an enlarged opening with respect to said outer lateral surface and at another opposite end a restricted opening with respect to said outer lateral surface.

* * * * *